US009630682B1

(12) United States Patent
Yost

(10) Patent No.: US 9,630,682 B1
(45) Date of Patent: Apr. 25, 2017

(54) ROPE STORAGE SYSTEM

(71) Applicant: Verl Yost, Wendell, NC (US)

(72) Inventor: Verl Yost, Wendell, NC (US)

( * ) Notice: Subject to any disclaimer, the term of this patent is extended or adjusted under 35 U.S.C. 154(b) by 0 days.

(21) Appl. No.: 14/932,559

(22) Filed: Nov. 4, 2015

(51) Int. Cl.
*B63B 21/20* (2006.01)
*B63B 21/04* (2006.01)
*B63B 21/00* (2006.01)

(52) U.S. Cl.
CPC ..... *B63B 21/20* (2013.01); *B63B 21/045* (2013.01); *B63B 2021/003* (2013.01)

(58) Field of Classification Search
CPC ..... B63B 21/20; B63B 21/045
USPC ..... 114/218
See application file for complete search history.

(56) References Cited

U.S. PATENT DOCUMENTS 2,915,259 A * 12/1959 Force ..... B63B 35/816 114/254
3,315,914 A * 4/1967 Turner ..... B61B 12/10 242/390.1
4,133,496 A * 1/1979 Zetah ..... B63B 35/815 114/254
4,969,610 A * 11/1990 Taylor ..... B63B 35/816 114/254
D334,960 S 4/1993 Goodman
6,474,588 B2 * 11/2002 Valverde ..... B63B 35/816 114/254
7,841,287 B2 * 11/2010 Wingate ..... B60P 7/0823 114/230.2
2005/0029381 A1 * 2/2005 Lamonica ..... B65H 75/4431 242/385.4
2008/0054118 A1 * 3/2008 Czajkowski ..... B63B 35/815 242/395
2008/0257999 A1 * 10/2008 Wingate ..... B60P 7/0823 242/376

* cited by examiner

*Primary Examiner* — Lars A Olson
*Assistant Examiner* — Jovon Hayes

(57) ABSTRACT

A rope storage system includes a boat that has at least one cleat coupled to the boat. A retracting unit is removably coupled to the at least one cleat. A rope is releasably contained within the retracting unit. The rope is selectively urged outwardly from the retracting unit and the rope may secure the boat to a restraint. The rope is biased into the retracting unit such that the rope is stored within the retracting unit. Thus, the retracting unit reduces a tripping hazard with respect to the rope. A cleat lock is movably coupled to the retracting unit. The cleat lock releasably engages the at least one cleat such that the retracting unit is removably retained on the at least one cleat.

17 Claims, 7 Drawing Sheets

ROPE STORAGE SYSTEM

BACKGROUND OF THE DISCLOSURE

Field of the Disclosure

The disclosure relates to storage devices and more particularly pertains to a new storage device for retractably coupling a rope to a boat.

SUMMARY OF THE DISCLOSURE

An embodiment of the disclosure meets the needs presented above by generally comprising a boat that has at least one cleat coupled to the boat. A retracting unit is removably coupled to the at least one cleat. A rope is releasably contained within the retracting unit. The rope is selectively urged outwardly from the retracting unit and the rope may secure the boat to a restraint. The rope is biased into the retracting unit such that the rope is stored within the retracting unit. Thus, the retracting unit reduces a tripping hazard with respect to the rope. A cleat lock is movably coupled to the retracting unit. The cleat lock releasably engages the at least one cleat such that the retracting unit is removably retained on the at least one cleat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
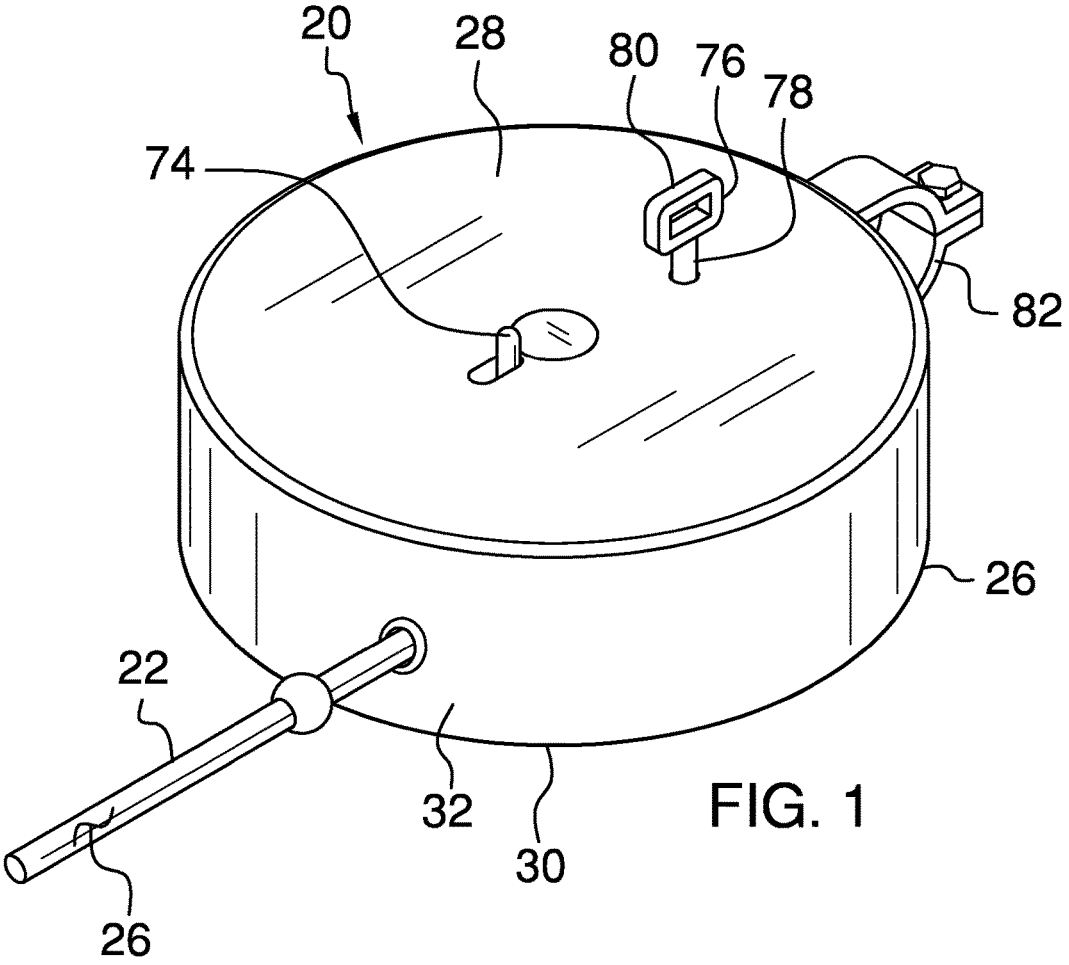
FIG. 1 is a front perspective view of a rope storage system according to an embodiment of the disclosure.
Figure 2:
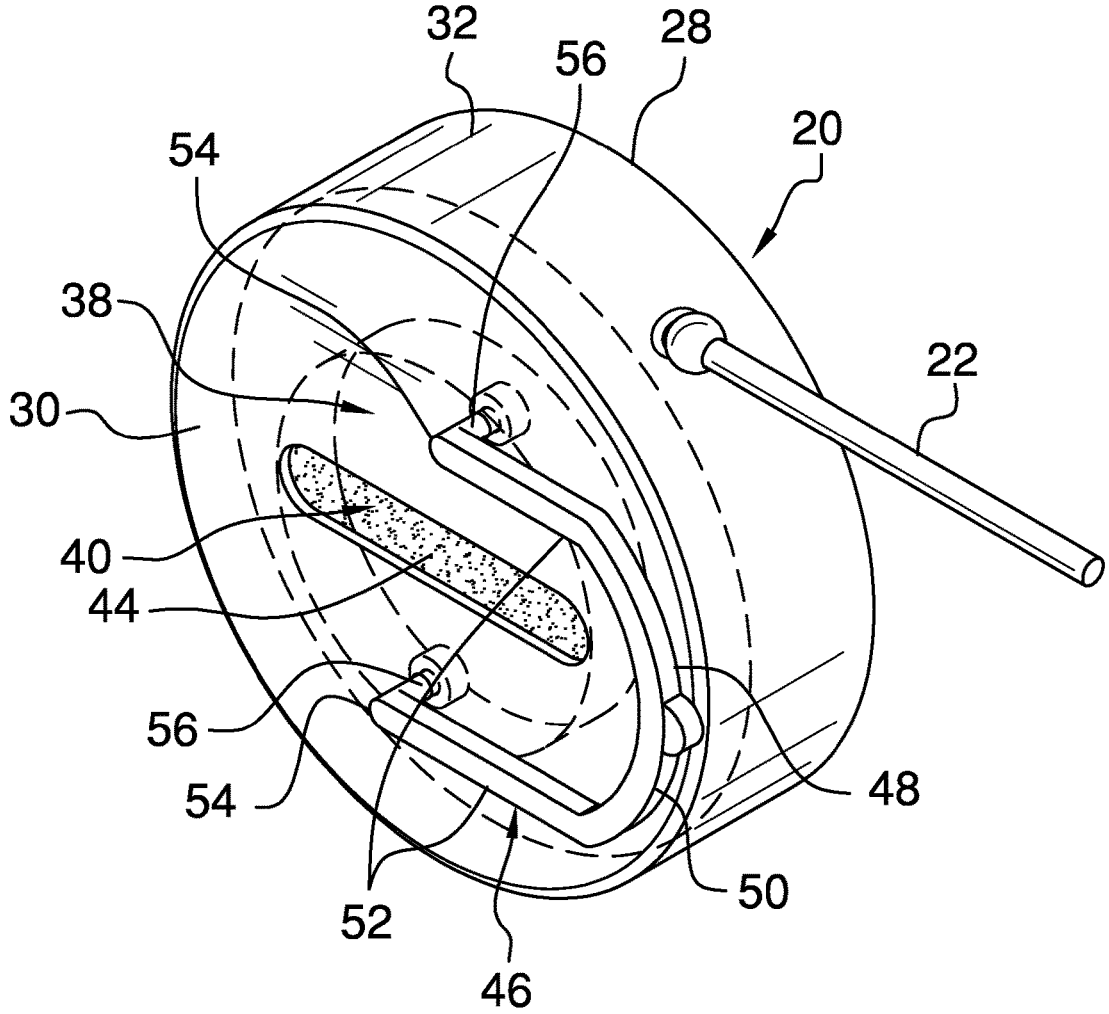
FIG. 2 is a back perspective view of an embodiment of the disclosure.
Figure 3:
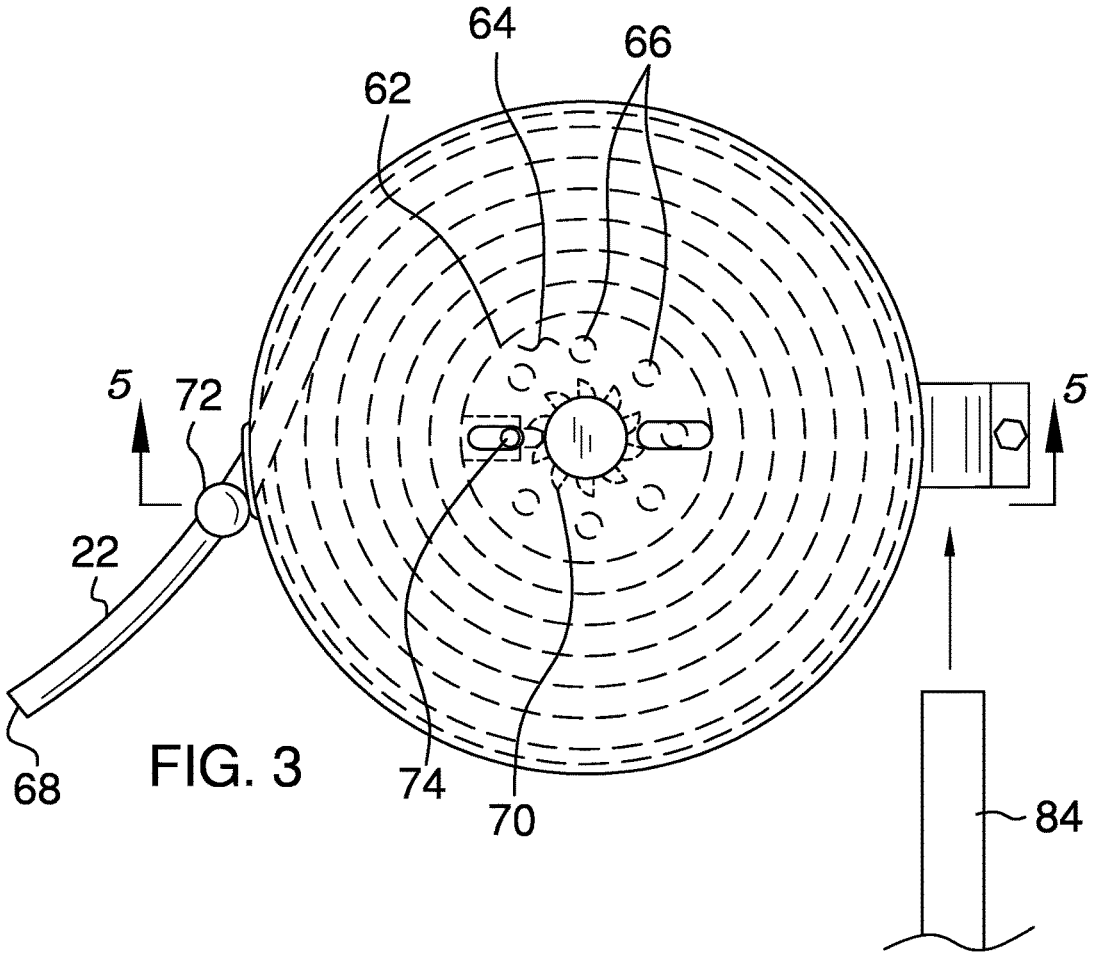
FIG. 3 is a front phantom view of an embodiment of the disclosure.
Figure 4:
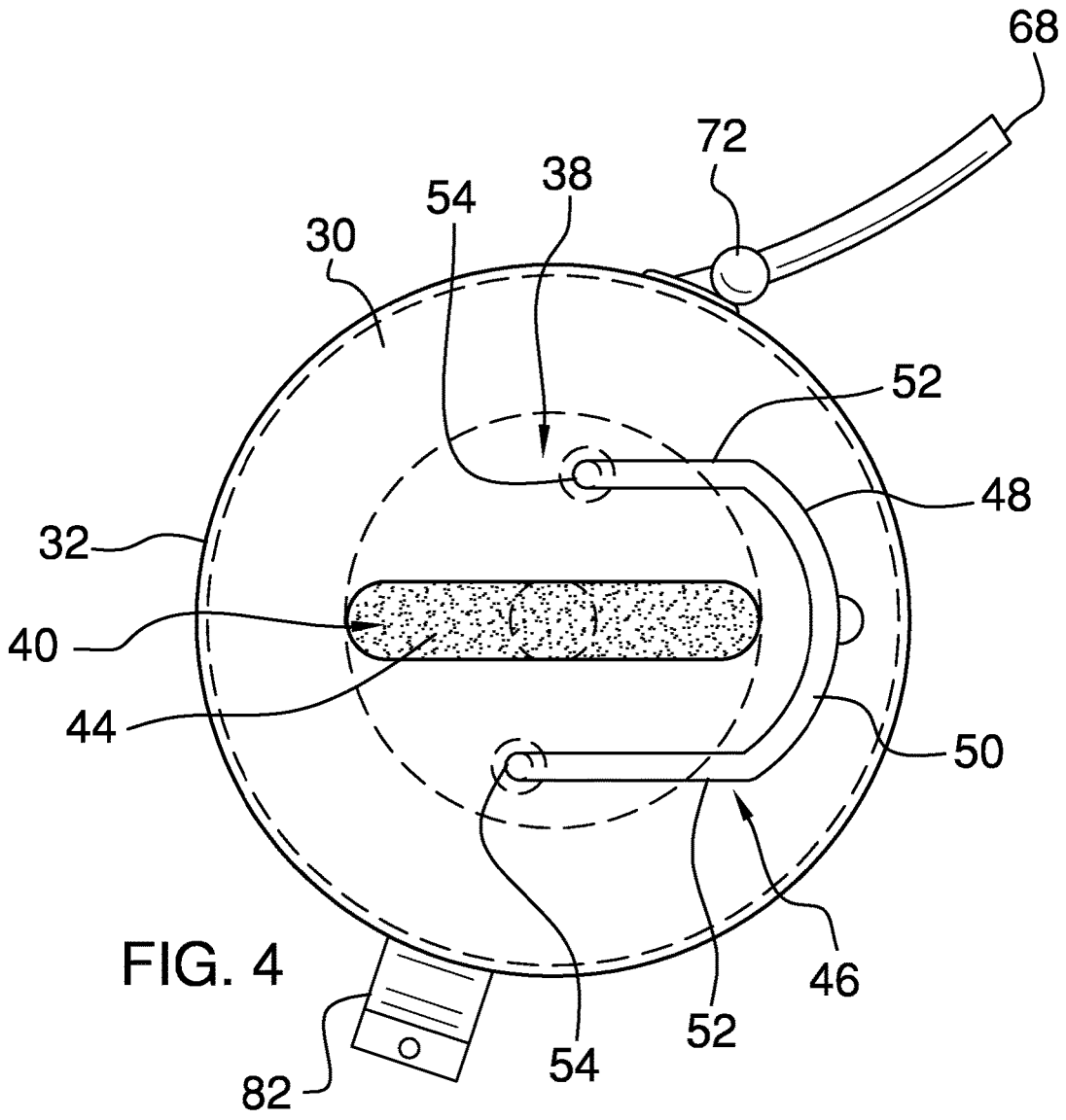
FIG. 4 is a back phantom view of an embodiment of the disclosure.
Figure 5:
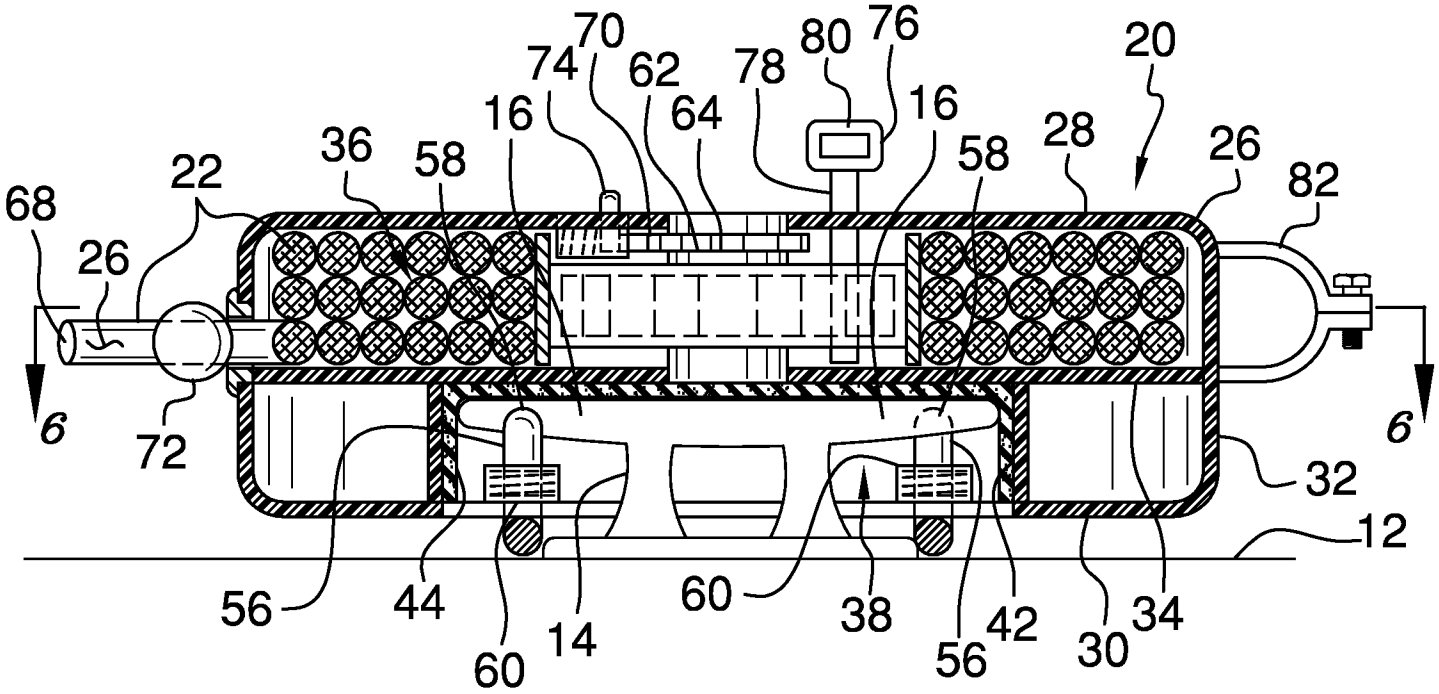
FIG. 5 is a cross sectional view taken along line 5-5 of FIG. 3 of an embodiment of the disclosure.
Figure 6:
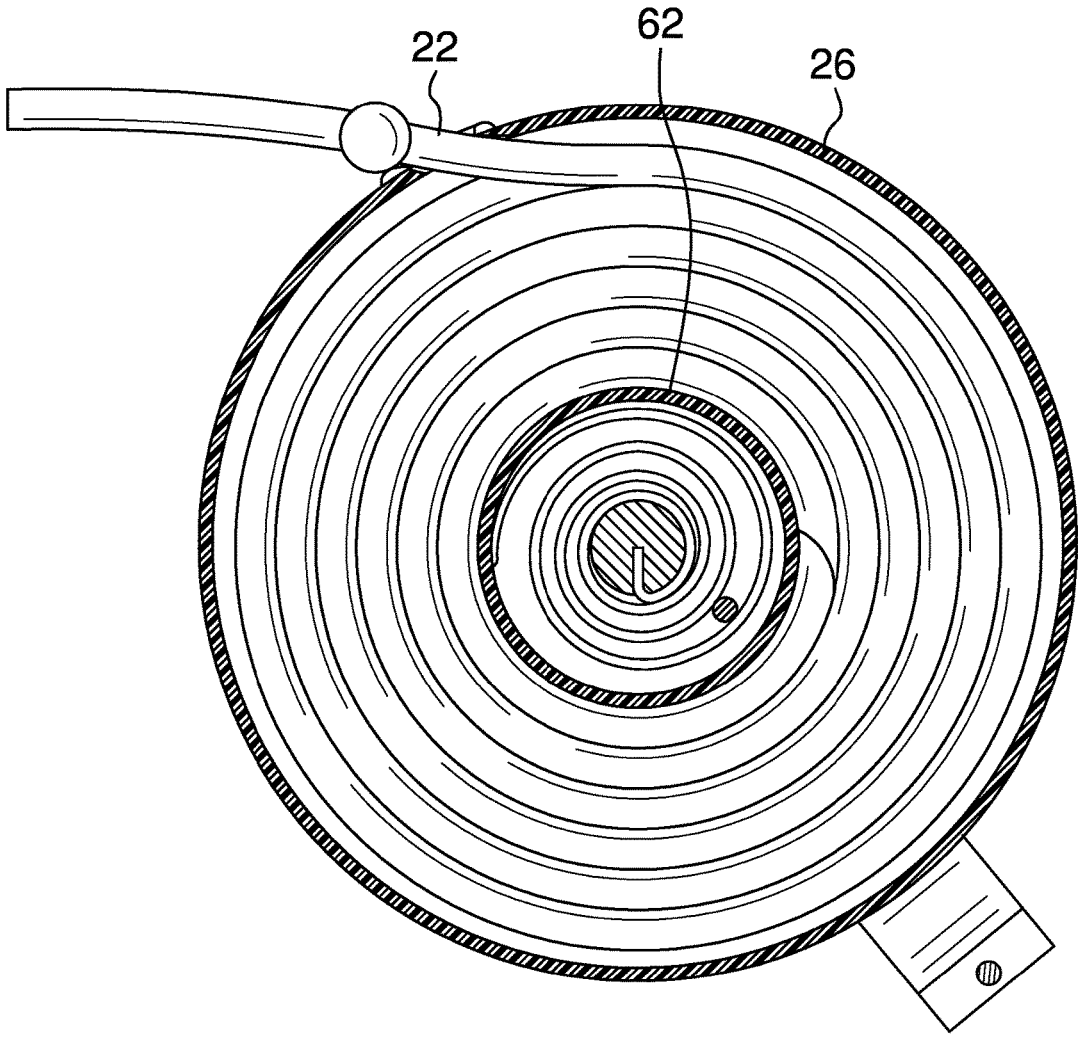
FIG. 6 is a cross sectional view taken along line 6-6 of FIG. 5 of an embodiment of the disclosure.
Figure 7:
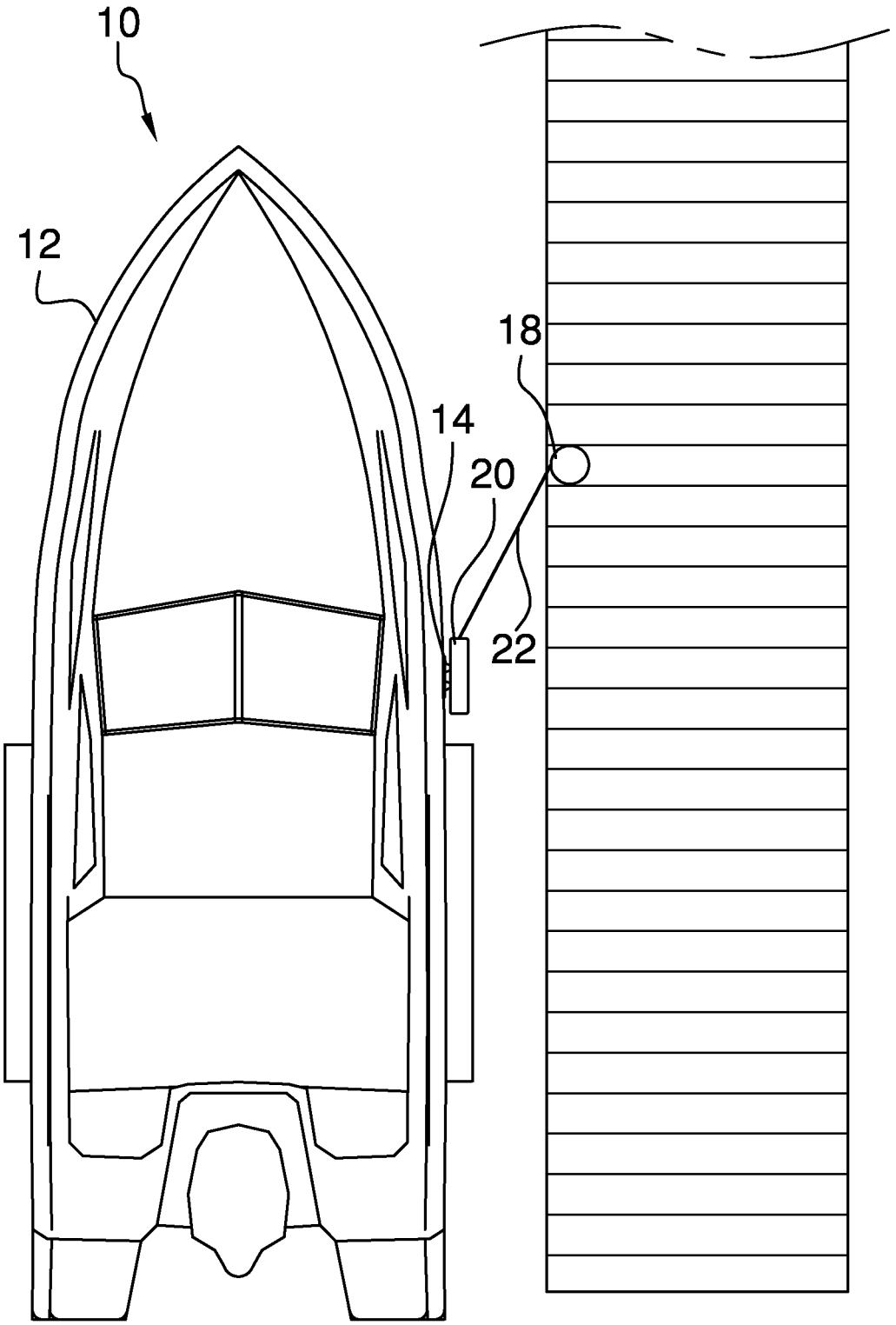
FIG. 7 is a perspective in-use view of an embodiment of the disclosure.

With reference now to the drawings, and in particular to FIGS. 1 through 7 thereof, a new storage device embodying the principles and concepts of an embodiment of the disclosure and generally designated by the reference numeral 10 will be described.

As best illustrated in FIGS. 1 through 7, the rope storage system 10 generally comprises a boat 12 and at least one cleat 14 that is coupled to the boat 12. The at least one cleat 14 has a pair of cleat arms 16 and each of the cleat arms 16 is spaced from the boat 12. The boat 12 may be a boat of any conventional design. The at least one cleat 14 may be a cleat associated with securing the boat 12 to a restraint 18.

A retracting unit 20 is removably coupled to the at least one cleat 14. The retracting unit 20 includes a rope 22 that is releasably contained within the retracting unit 20. The rope 22 is selectively urged outwardly from the retracting unit 20. Thus, rope 22 may secure the boat 12 to the restraint 18. The restraint 18 may comprise a boat dock or the like.

The rope 22 is biased into the retracting unit 20 such that the rope 22 is stored within the retracting unit 20. Thus, the retracting unit 20 reduces a tripping hazard with respect to the rope 22. The rope 22 has a protective coating 24. The protective coating 24 may be comprised of a flexible and fluid impermeable material. Thus, the protective coating 24 protects the rope 22 from water damage.

The retracting unit 20 comprises a housing 26 that has a first wall 28, a second wall 30 and a peripheral wall 32 extending between the first wall 28 and the second wall 30. The housing 26 includes a medial wall 34 that is positioned between the first wall 28 and the second wall 30. The medial wall 34 defines a rope space 36 between the medial wall 34 and the first wall 28. The medial wall 34 additionally defines a cleat space 38 between the medial wall 34 and the second wall 30.

The second wall 30 has a slot 40 extending into the cleat space 38. The slot 40 extends substantially along the cleat space 38 and the cleat space 38 has a bounding surface 42. The housing 26 is positioned such that the at least one cleat 14 extends through the slot 40 having each of the cleat arms 16 positioned within the cleat space 38. A cushion 44 is coupled to the bounding surface 42 of the cleat space 38. The cushion 44 is comprised of a resiliently compressible and fluid impermeable material. Thus, the cushion 14 inhibits the at least one cleat 14 from damaging the housing 26.

A cleat lock 46 is movably coupled to the retracting unit 20. The cleat lock 46 releasably engages the at least one cleat 14. Thus, the retracting unit 20 is removably retained on the at least one cleat 14. The cleat lock 46 comprises a handle 48 that has a central member 50 and a pair of lateral members 52 extending away from the central member 52. The lateral members 52 are spaced apart from each other and each of the lateral members 52 has a distal end 54 with respect to the central member 52.

A pair of secondary arms 56 is provided and each of the secondary arms 56 is coupled to and extends away from an associated one of the lateral members 52. Each of the secondary arms 56 is positioned on the distal end 54 of the associated lateral member 52. Each of the secondary arms 56 extends through the second wall 30 of the housing 26 such that each of the secondary arms 56 extends into the cleat space 38. Each of the secondary arms 56 is aligned with and oriented perpendicular with a bisecting line extending laterally through the slot 40. Each of the secondary arms 56 has a distal end 58 with respect to the associated lateral member 52.

A pair of biasing members 60 is provided and each of the biasing members 60 is positioned around an associated one of the secondary arms 56. Each of the biasing members 60 is positioned between the second wall 30 and the distal end 58 corresponding to the secondary arms 56. Thus, each of the biasing members 60 biases the cleat lock 46 into a locking position having the associated secondary arm 56 extending into the cleat space 38. The cleat lock 46 is urged into a releasing position having each of the secondary arms 56 substantially urged outwardly from the cleat space 38.

A spool 62 is rotatably positioned within the rope space 36. The spool 62 has a first surface 64 and the first surface 64 is spaced from the first wall 28 of the housing 26. The first surface 64 has a plurality of apertures 66 extending therethrough. The apertures 66 are spaced apart from each other and are distributed around the spool 62.

The spool 62 rotates about an axis extending through the first wall 28 and the second wall 30. The spool 62 is biased to rotate in a retracting direction and the spool 62 is urged to rotate in a releasing direction. The rope 22 is rolled around the spool 62 and the rope 22 has a distal end 68 with respect to the spool 62. The rope 22 extends outwardly from the peripheral wall 32 of the housing 26 and the distal end 68 corresponding to the rope 22 is exposed. The spool 62 may comprise a spring loaded spool or the like.

A gear 70 is coupled to the spool 62 and the gear 70 is positioned between the first surface 64 and the first wall 28. A stop 72 is coupled to the rope 22 and the stop 72 is positioned proximate the distal end 68 corresponding to the rope 22. The stop 72 engages the peripheral wall 32 of the housing 26 when the spool 62 rotates in the retracting direction. Thus, distal end 68 corresponding to the rope 22 may be manipulated. The spool 62 rotates in the releasing direction when the rope 22 is urged outwardly from the housing 26.

A spool lock 74 is slidably coupled to the first wall 28 and the spool lock 74 may be manipulated. The spool lock 74 is biased to engage the gear 70 such that the spool lock 74 inhibits the spool 62 from rotating in the retracting direction. A key 76 is provided and the key 76 has a shaft 78 and a head 80. The shaft 78 is extended through the first wall 28 and engages a selected one of the apertures 66 in the spool 62. Thus, the key 76 retains the spool 62 at a selected point of rotation.

A clamp 82 is coupled to the peripheral wall 32 of the housing 26. The clamp 82 may comprise a pipe clamp or the like. Thus, the clamp 82 may selectively engage a stanchion 84. The housing 26 is removably coupled to the stanchion 84 when the boat 12 does not have at least one cleat 14. The stanchion 84 is coupled to the boat 12 and the stanchion 84 may comprise a ski pole, a hand railing or other stanchion associated with boats.

In use, the cleat lock 46 is urged into the releasing position when the at least one cleat 14 is positioned in the cleat space 38. The housing 26 is rotated in a locking direction when the cleat lock 46 is urged into the releasing position having a line extending through each of the cleat arms 16 being offset with respect to the bisecting line. The cleat lock 46 is biased into the locking position when the housing 26 is rotated into the locking position. Each of the secondary arms 56 frictionally engages opposite sides of an associated one of the cleat arms 16 when the cleat lock 46 is biased into the locking position. Thus, the housing 26 is inhibited from being removed from the at least one cleat 14.

The rope 22 is urged outwardly from the housing 26 and the rope 22 is coupled to the restraint 18. Thus, the boat 12 is coupled to the restraint 18. The rope 22 is uncoupled from the restraint 18 and the spool lock 74 is manipulated. The spool 62 is biased to rotate in the retracting direction and the rope 22 is retracted into the housing 26. The key 76 is inserted into the housing 26 when a selected length of rope 22 is urged outwardly from the housing 26. The key 76 inhibits the rope 22 from being retracted into the housing 26. Thus, the rope 22 is retained at the selected length.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rope storage system comprising:

a boat having at least one cleat being coupled to said boat;

a retracting unit being removably coupled to said at least one cleat, said retracting unit including a rope being releasably contained within said retracting unit, said rope being selectively urged outwardly from said retracting unit wherein said rope is configured to secure said boat to a restraint, said rope being biased into said retracting unit such that said rope is stored within said retracting unit wherein said retracting unit is configured to reduce a tripping hazard with respect to said rope; and a cleat lock being movably coupled to said retracting unit, said cleat lock releasably engaging said at least one cleat such that said retracting unit is removably retained on said at least one cleat; and wherein said cleat lock comprises a handle having a central member and a pair of lateral members extending away from said central member, each of said lateral members being spaced apart from each other, each of said lateral members having a distal end with respect to said central members.

2. The system according to claim 1, wherein:

said at least one cleat has a pair of cleat arms, each of said cleat arms being spaced from said boat; and said retracting unit comprises a housing having a first wall, a second wall and a peripheral wall extending between said first wall and said second wall, said housing including a medial wall being positioned between said first wall and said second wall such that said medial wall defines a rope space between said medial wall and said first wall and a cleat space between said medial wall and said second wall.

3. A rope storage system comprising:

a boat having at least one cleat being coupled to said boat;

a retracting unit being removably coupled to said at least one cleat, said retracting unit including a rope being releasably contained within said retracting unit, said rope being selectively urged outwardly from said retracting unit wherein said rope is configured to secure said boat to a restraint, said rope being biased into said retracting unit such that said rope is stored within said retracting unit wherein said retracting unit is configured to reduce a tripping hazard with respect to said rope;

a cleat lock being movably coupled to said retracting unit, said cleat lock releasably engaging said at least one cleat such that said retracting unit is removably retained on said at least one cleat;

said at least one cleat having a pair of cleat arms, each of said cleat arms being spaced from said boat;

said retracting unit comprising a housing having a first wall, a second wall and a peripheral wall extending between said first wall and said second wall, said housing including a medial wall being positioned between said first wall and said second wall such that said medial wall defines a rope space between said medial wall and said first wall and a cleat space between said medial wall and said second wall; and wherein said second wall has a slot extending into said cleat space, said slot extending substantially along said cleat space, said cleat space having a bounding surface, said housing being positioned such that said at least one cleat extends through said slot having each of said cleat arms being positioned within said cleat space.

4. The system according to claim 3, further comprising a cushion being coupled to said bounding surface of said cleat space, said cushion being comprised of a resiliently compressible and fluid impermeable material.

5. The system according to claim 1, further comprising a pair of secondary arms, each of said secondary arms being coupled to and extending away from an associated one of said lateral members, each of said secondary arms being positioned on said distal end of said associated lateral member.

6. The system according to claim 5, wherein:

said retracting unit includes a housing, said housing having a second wall, a slot and a cleat space; and each of said secondary arms extending through said second wall of said housing such that each of said secondary arms extends into said cleat space, each of said secondary arms being aligned with a bisecting line extending laterally through said slot, each of said secondary arms having a distal end with respect to said associated lateral member.

7. The system according to claim 6, further comprising a pair of biasing members, each of said biasing members being positioned around an associated one of said secondary arms, each of said biasing members being positioned between said second wall and said distal end corresponding to said secondary arms such that each of said biasing members biases said cleat lock into a locking position having said associated secondary arm extending into said cleat space.

8. The system according to claim 7, wherein:

said retracting unit includes a housing, said housing having a slot and a cleat space; and said cleat lock is urged into a releasing position having each of said secondary arms being substantially urged outwardly from said cleat space, said cleat lock being urged into said releasing position when said at least one cleat is positioned in said cleat space.

9. The system according to claim 8, wherein:

said at least one cleat has a pair of cleat arms;

said housing is rotated in a locking direction when said cleat lock is urged into said releasing position having a line extending through each of said cleat arms being offset with respect to said bisecting line; and said cleat lock is biased into said locking position when said housing is rotated into said locking position, each of said secondary arms frictionally engaging opposite sides of an associated one of said cleat arms when said cleat lock is biased into said locking position such that said housing is inhibited from being removed from said at least one cleat.

10. A rope storage system comprising:

a boat having at least one cleat being coupled to said boat;

a retracting unit being removably coupled to said at least one cleat, said retracting unit including a rope being releasably contained within said retracting unit, said rope being selectively urged outwardly from said retracting unit wherein said rope is configured to secure said boat to a restraint, said rope being biased into said retracting unit such that said rope is stored within said retracting unit wherein said retracting unit is configured to reduce a tripping hazard with respect to said rope;

a cleat lock being movably coupled to said retracting unit, said cleat lock releasably engaging said at least one cleat such that said retracting unit is removably retained on said at least one cleat;

said at least one cleat having a pair of cleat arms, each of said cleat arms being spaced from said boat;

said retracting unit comprising a housing having a first wall, a second wall and a peripheral wall extending between said first wall and said second wall, said housing including a medial wall being positioned between said first wall and said second wall such that said medial wall defines a rope space between said medial wall and said first wall and a cleat space between said medial wall and said second wall; and a spool being rotatably positioned within said rope space, said spool having a first surface, said first surface being spaced from said first wall of said housing, said first surface having a plurality of apertures extending therethrough, said apertures being spaced apart from each other and being distributed around said spool, said spool being biased to rotate in a retracting direction, said spool being urged to rotate in a releasing direction.

11. The system according to claim 10, wherein said rope is rolled around said spool, said rope having a distal end with respect to said spool, said rope extending outwardly from said peripheral wall of said housing having said distal end corresponding to said rope being exposed.

12. The system according to claim 11, further comprising a gear being coupled to said spool, said gear being positioned between said first surface and said first wall.

13. The system according to claim 11, further comprising a stop being coupled to said rope, said stop being positioned adjacent to said distal end corresponding to said rope, said stop engaging said peripheral wall of said housing when said spool rotates in said retracting direction wherein said distal end corresponding to said rope is configured to be manipulated, said spool rotating in said releasing direction when said rope is urged outwardly from said housing.

14. The system according to claim 12, further comprising a spool lock being slidably coupled to said first wall wherein said spool lock is configured to be manipulated, said spool lock being biased to engage said gear such that said spool lock inhibits said spool from rotating in said retracting direction.

15. The system according to claim 10, further comprising a key having a shaft and a head, said shaft being extended through said first wall and engaging a selected one of said apertures in said spool such that said key retains said spool at a selected point of rotation.

16. A rope storage system comprising:

a boat having at least one cleat being coupled to said boat;

a retracting unit being removably coupled to said at least one cleat, said retracting unit including a rope being releasably contained within said retracting unit, said rope being selectively urged outwardly from said retracting unit wherein said rope is configured to secure said boat to a restraint, said rope being biased into said retracting unit such that said rope is stored within said retracting unit wherein said retracting unit is configured to reduce a tripping hazard with respect to said rope;

a cleat lock being movably coupled to said retracting unit, said cleat lock releasably engaging said at least one cleat such that said retracting unit is removably retained on said at least one cleat;

said at least one cleat having a pair of cleat arms, each of said cleat arms being spaced from said boat;

said retracting unit comprising a housing having a first wall, a second wall and a peripheral wall extending between said first wall and said second wall, said housing including a medial wall being positioned between said first wall and said second wall such that said medial wall defines a rope space between said medial wall and said first wall and a cleat space between said medial wall and said second wall; and a clamp being coupled to said peripheral wall of said housing wherein said clamp is configured to selectively engage a stanchion.

17. A rope storage system comprising:

a boat having at least one cleat being coupled to said boat, said at least one cleat having a pair of cleat arms, each of said cleat arms being spaced from said boat; and a retracting unit being removably coupled to said at least one cleat, said retracting unit including a rope being releasably contained within said retracting unit, said rope being selectively urged outwardly from said retracting unit wherein said rope is configured to secure said boat to a restraint, said rope being biased into said retracting unit such that said rope is stored within said retracting unit wherein said retracting unit is configured to reduce a tripping hazard with respect to said rope, said retracting unit comprising:

a housing having a first wall, a second wall and a peripheral wall extending between said first wall and said second wall, said housing including a medial wall being positioned between said first wall and said second wall such that said medial wall defines a rope space between said medial wall and said first wall and a cleat space between said medial wall and said second wall, said second wall having a slot extending into said cleat space, said slot extending substantially along said cleat space, said cleat space having a bounding surface, said housing being positioned such that said at least one cleat extends through said slot having each of said cleat arms being positioned within said cleat space, a cushion being coupled to said bounding surface of said cleat space, said cushion being comprised of a resiliently compressible and fluid impermeable material, a cleat lock being movably coupled to said retracting unit, said cleat lock releasably engaging said at least one cleat such that said retracting unit is removably retained on said at least one cleat, said cleat lock comprising:

a handle having a central member and a pair of lateral members extending away from said central member, each of said lateral members being spaced apart from each other, each of said lateral members having a distal end with respect to said central members, a pair of secondary arms, each of said secondary arms being coupled to and extending away from an associated one of said lateral members, each of said secondary arms being positioned on said distal end of said associated lateral member, each of said secondary arms extending through said second wall of said housing such that each of said secondary arms extends into said cleat space, each of said secondary arms being aligned with a bisecting line extending laterally through said slot, each of said secondary arms having a distal end with respect to said associated lateral member, and a pair of biasing members, each of said biasing members being positioned around an associated one of said secondary arms, each of said biasing members being positioned between said second wall and said distal end corresponding to said secondary arms such that each of said biasing members biases said cleat lock into a locking position having said associated secondary arm extending into said cleat space, said cleat lock being urged into a releasing position having each of said secondary arms being substantially urged outwardly from said cleat space, said cleat lock being urged into said releasing position when said at least one cleat is positioned in said cleat space, said housing being rotated in a locking direction when said cleat lock is urged into said releasing position having a line extending through each of said cleat arms being offset with respect to said bisecting line, said cleat lock being biased into said locking position when said housing is rotated into said locking position, each of said secondary arms frictionally engaging opposite sides of an associated one of said cleat arms when said cleat lock is biased into said locking position such that said housing is inhibited from being removed from said at least one cleat;

a spool being rotatably positioned within said rope space, said spool having a first surface, said first surface being spaced from said first wall of said housing, said first surface having a plurality of apertures extending therethrough, said apertures being spaced apart from each other and being distributed around said spool, said spool being biased to rotate in a retracting direction, said spool being urged to rotate in a releasing direction, said rope being rolled around said spool, said rope having a distal end with respect to said spool, said rope extending outwardly from said peripheral wall of said housing having said distal end corresponding to said rope being exposed;

a gear being coupled to said spool, said gear being positioned between said first surface and said first wall;

a stop being coupled to said rope, said stop being positioned adjacent to said distal end corresponding to said rope, said stop engaging said peripheral wall of said housing when said spool rotates in said retracting direction wherein said distal end corresponding to said rope is configured to be manipulated, said spool rotating in said releasing direction when said rope is urged outwardly from said housing;

a spool lock being slidably coupled to said first wall wherein said spool lock is configured to be manipulated, said spool lock being biased to engage said gear such that said spool lock inhibits said spool from rotating in said retracting direction;

a key having a shaft and a head, said shaft being extended through said first wall and engaging a selected one of said apertures in said spool such that said key retains said spool at a selected point of rotation; and a clamp being coupled to said peripheral wall of said housing wherein said clamp is configured to selectively engage a stanchion.

* * * * *